US009336759B2

(12) United States Patent
Mori

(10) Patent No.: US 9,336,759 B2
(45) Date of Patent: May 10, 2016

(54) ELECTRONIC PAD

(71) Applicant: ROLAND CORPORATION, Shizuoka (JP)

(72) Inventor: Yoshiaki Mori, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 14/753,035

(22) Filed: Jun. 29, 2015

(65) Prior Publication Data

US 2016/0019873 A1 Jan. 21, 2016

(30) Foreign Application Priority Data

Jul. 16, 2014 (JP) ..... 2014-146332

(51) Int. Cl.

| | |
|---|---|
| ***G10D 13/02*** | (2006.01) |
| ***G10D 13/06*** | (2006.01) |
| ***G10H 1/00*** | (2006.01) |
| ***G10H 1/32*** | (2006.01) |
| ***G10H 3/14*** | (2006.01) |

(52) U.S. Cl.

CPC ..... *G10D 13/06* (2013.01); *G10D 13/024* (2013.01); *G10H 1/00* (2013.01); *G10H 1/32* (2013.01); *G10H 3/146* (2013.01); *G10H 2220/525* (2013.01); *G10H 2230/281* (2013.01); *G10H 2230/321* (2013.01)

(58) Field of Classification Search

CPC ..... G10D 13/024; G10D 13/06; G10D 1/00; G10D 1/32; G10D 3/146

See application file for complete search history.

(56) References Cited

U.S. PATENT DOCUMENTS

| | | | | | |
|---|---|---|---|---|---|
| 4,479,412 | A | * | 10/1984 | Klynas | G10H 3/143 84/730 |
| 5,042,356 | A | * | 8/1991 | Karch | G10D 13/024 84/104 |
| 5,115,706 | A | * | 5/1992 | Aluisi | G10D 13/024 84/723 |
| 5,965,834 | A | * | 10/1999 | Suenaga | G10D 13/06 84/422.3 |

(Continued)

FOREIGN PATENT DOCUMENTS

| | | |
|---|---|---|
| EP | 0855698 | 7/1998 |
| JP | H07-295561 | 11/1995 |

(Continued)

OTHER PUBLICATIONS

"The Extended European Search Report of European Counterpart Application", issued on Feb. 17, 2016, pp. 1-10.

*Primary Examiner* — Robert W Horn

(74) *Attorney, Agent, or Firm* — Jianq Chyun IP Office

(57) ABSTRACT

The present invention provides an electronic pad, including: a struck body, including a first struck portion and a second struck portion; a first and a second vibration sensor, detecting a vibration of the first struck portion and the second struck portion. In the electronic pad, a partitioning portion is interposed between the first struck portion and the second struck portion for partitioning. The partitioning portion includes: a first upright portion, protruding further than at least one of an upper surface of the first struck portion and a lower surface opposite the upper surface; a second upright portion, separated from the first upright portion by a predetermined spacing and protruding further than at least one of an upper surface of the second struck portion and a lower surface opposite the upper surface; and a connection portion connected between the first upright portion and the second upright portion.

19 Claims, 6 Drawing Sheets

(56) References Cited

U.S. PATENT DOCUMENTS

| | | | | |
|---|---|---|---|---|
| 6,822,148 | B2 * | 11/2004 | Yanase | G10D 13/024 84/422.1 |
| 6,881,885 | B2 * | 4/2005 | Yoshino | G10D 13/024 84/402 |
| 7,737,351 | B2 * | 6/2010 | Suzuki | G10D 13/024 428/35.7 |
| 8,063,296 | B2 * | 11/2011 | Copeland | G10H 1/0066 84/411 R |
| 8,088,986 | B2 * | 1/2012 | Takehisa | G10H 3/146 84/411 P |
| 8,461,445 | B2 * | 6/2013 | Takehisa | G10H 1/24 84/615 |
| 8,729,379 | B2 * | 5/2014 | Wallace | G01D 13/024 84/733 |
| 8,742,244 | B2 * | 6/2014 | Wissmuller | G10H 3/00 84/723 |
| 8,937,239 | B2 * | 1/2015 | Takasaki | 84/737 |
| 9,165,544 | B2 * | 10/2015 | Yoshino | G10H 3/146 |
| 2002/0059861 | A1 * | 5/2002 | Yoshino | G10D 13/024 84/402 |
| 2002/0062726 | A1 * | 5/2002 | Abe | G10H 1/0016 84/464 A |
| 2008/0105104 | A1 | 5/2008 | Stannard | |
| 2014/0116227 | A1 | 5/2014 | Yoshino | |
| 2014/0260916 | A1 * | 9/2014 | Oppel | G10H 3/146 84/626 |
| 2016/0019873 | A1 * | 1/2016 | Mori | G10H 1/32 84/422.1 |

FOREIGN PATENT DOCUMENTS

| | | |
|---|---|---|
| JP | H07-311577 | 11/1995 |
| JP | 4161914 | 10/2008 |
| JP | 2009-145559 | 7/2009 |
| WO | 02/19314 | 3/2002 |

* cited by examiner 70
140
91a (91)
92b (92)
130
91b (91)
96 (90)
101b
95 (90)

70
74
Vb
73
96 (90)
95 (90)
92b (92)
Vc
140
91a (91)
130
91b (91)
Vc
101a
110
101b
120
93 (90)
92a (92)
94 (90)
71
Vb
72

102b
84
83
102 (100)
82 (80)
92b (92)
81 (80)
101 (100)
130
95 (90)
101a (100)
91b (91)
92a (92)
120
94 (90)
70

ELECTRONIC PAD

CROSS-REFERENCE TO RELATED APPLICATIONS

This application claims the priority benefit of Japan application serial no. 2014-146332, filed on Jul. 16, 2014. The entirety of the above-mentioned patent application is hereby incorporated by reference herein and made a part of this specification.

BACKGROUND OF THE INVENTION

1. Field of the Invention

The present invention relates to an electronic pad. Particularly, the present invention relates to an electronic pad capable of correctly specifying a striking position by use of a vibration sensor.

2. Description of Related Art

Conventionally, electronic pads such as cymbal pads, drum pads and so on have been known. For example, the following Patent Literature 1 discloses a striking pad for electronic drums, wherein by arrangement of a sheet sensor on an entire surface of a struck body, the striking pad is capable of correctly specifying a striking position. However, the sheet sensor is expensive. Furthermore, the sheet sensor is a contact sensor and thus is only capable of detecting whether striking occurs or not. Thus, there have been limitations on detection of a performer's natural performance expression by the sheet sensor.

Meanwhile, there has also been known an electronic pad in which a plurality of vibration sensors are arranged on a struck body and a striking position is specified according to an output difference (also known as output ratio, and the same applies hereinafter) between adjacent vibration sensors. The vibration sensor is cheaper than the sheet sensor. Furthermore, the vibration sensor is also capable of detecting striking intensity. Therefore, the vibration sensor is capable of more reliably detecting a performer's natural performance expression.

However, in the case where the striking position is specified according to the output difference between the vibration sensors, there is a problem that, if the output difference between the compared vibration sensors is small, the striking position cannot be correctly specified.

PRIOR ART LITERATURE

Patent Literature

[Patent Literature 1] Japanese Patent No. 4161914.

SUMMARY OF THE INVENTION

The present invention has been accomplished in order to solve the above-mentioned problem. Particularly, the present invention is intended to provide an electronic pad capable of correctly specifying a striking position by use of a vibration sensor.

According to an electronic pad of a technical solution of the present invention, the following effects are obtained. A vibration transmitted between a first struck portion and a second struck portion is transmitted through a partitioning portion interposed between the first struck portion and the second struck portion. The partitioning portion includes a first upright portion, a second upright portion and a connection portion. The first upright portion is a part protruding further than at least one of an upper surface of the first struck portion and a lower surface opposite the upper surface. The second upright portion is a part separated from the first upright portion by a predetermined spacing and protruding further than at least one of an upper surface of the second struck portion and a lower surface opposite the upper surface. The connection portion is a part connected between the first upright portion and the second upright portion. Hence, when the first struck portion is struck, the vibration is transmitted from the first struck portion to the second struck portion through the first upright portion, the connection portion and the second upright portion. That is, compared to a case where the vibration is directly transmitted from the first struck portion to the second struck portion, in the state where the vibration is transmitted to the second struck portion through the first upright portion, the connection portion and the second upright portion, a distance that the vibration is transmitted to reach the second struck portion is increased. Accordingly, the vibration can be attenuated and transmitted to the second struck portion. Or, the first upright portion protrudes from the first struck portion, and the second upright portion protrudes from the second struck portion. Thus, in the first struck portion and the second struck portion, particularly parts where the first upright portion and the second upright portion protrude have higher rigidity than the connection portion connected to the first upright portion and the second upright portion. That is, the first struck portion including the first upright portion and the second struck portion including the second upright portion approach a state of being elastically supported by the connection portion. Thus, the vibration is attenuated by the connection portion. Accordingly, the vibration of the first struck portion can be attenuated and transmitted to the second struck portion. In this manner, when the first struck portion is struck, the vibration is attenuated by the partitioning portion and then transmitted to the second struck portion. Moreover, similarly to the case where the first struck portion is struck, if the second struck portion is struck, the vibration is attenuated by the partitioning portion and then transmitted to the first struck portion. Thus, an output difference between an output of a first vibration sensor (i.e., the vibration of the first struck portion detected by the first vibration sensor) and an output of the second vibration sensor (i.e., the vibration of the second struck portion detected by the second vibration sensor) can be increased. Accordingly, a striking position can be correctly specified by use of the vibration sensors.

Moreover, the first upright portion and the second upright portion include the following aspects. In one aspect, the first upright portion protrudes from the upper surface of the first struck portion, and the second upright portion protrudes from the upper surface of the second struck portion. In one aspect, the first upright portion protrudes from the lower surface of the first struck portion, and the second upright portion protrudes from the lower surface of the second struck portion. In one aspect, the first upright portion protrudes from the upper surface of the first struck portion, and the second upright portion protrudes from the lower surface of the second struck portion. In one aspect, the first upright portion protrudes from the lower surface of the first struck portion, and the second upright portion protrudes from the upper surface of the second struck portion. In one aspect, the first upright portion protrudes from both the upper surface and the lower surface of the first struck portion, and the second upright portion protrudes from either or both of the upper surface and the lower surface of the second struck portion. In one aspect, the second upright portion protrudes from both the upper surface and the lower surface of the second struck portion, and the first upright portion protrudes from either or both of the upper surface and the lower surface of the first struck portion.

According to an electronic pad of another technical solution of the present invention, in addition to the aforementioned effects, the following effects are obtained. The first upright portion and the second upright portion protrude further than the lower surface of the first struck portion and the second struck portion. The connection portion is connected between an end portion of a part of the first upright portion that protrudes further than the lower surface of the first struck portion and an end portion of a part of the second upright portion that protrudes further than the lower surface of the second struck portion. Thus, the vibration transmitted between the first struck portion and the second struck portion is transmitted while its direction is being changed by the partitioning portion. Accordingly, the vibration can be transmitted while being attenuated by the partitioning portion. In addition, the connection portion is connected between the end portion of the first upright portion and the end portion of the second upright portion. Thus, compared to a case where the connection portion is connected between an intermediate position on the first upright portion and an intermediate position on the second upright portion, a distance that the vibration is transmitted between the first struck portion and the second struck portion can be increased. Furthermore, the rigidity of the connection portion can be further reduced. Accordingly, the vibration can be more reliably attenuated by the connection portion. Furthermore, if a struck head is formed on the upper surface side of the first struck portion and the upper surface side of the second struck portion, the first upright portion, the second upright portion and the connection portion are located opposite the struck head. Thus, the first upright portion, the second upright portion and the connection portion can be prevented from obstructing the playing.

According to an electronic pad of another technical solution of the present invention, in addition to the aforementioned effects, the following effects are obtained. The first struck portion and the second struck portion are formed having a predetermined wall thickness. At least one of the first upright portion and the second upright portion is formed having a length, extending from the lower surface to an inner surface of the connection portion, equal to or greater than the predetermined wall thickness. Thus, a distance that the vibration makes a detour is extended. Furthermore, a difference between the rigidity of the first struck portion and the second struck portion and the rigidity of the partitioning portion including the connection portion can be further increased. Accordingly, the output difference between the first vibration sensor and the second vibration sensor can be further increased, and furthermore, the striking position can be correctly specified.

According to an electronic pad of another technical solution of the present invention, in addition to the aforementioned effects, the following effects are obtained. The connection portion is formed in an arc shape expanding in an opposite direction from the upper surface of the first struck portion and the second struck portion. Thus, for example, compared to a case where the partitioning portion has a V shape in a cross-sectional view, a path through which the vibration passes between the first struck portion and the second struck portion can be lengthened and the vibration can be easily attenuated. In addition, in the case where the partitioning portion has a V shape in a cross-sectional view, if the first struck portion or the second struck portion is struck, stress concentrates on a V-shaped bent portion. With respect to this, as described above, the connection portion is formed in an arc shape expanding in the opposite direction from the upper surface of the first struck portion and the second struck portion. Thus, the stress is dispersed. That is, the rigidity of the connection portion can be further reduced. Accordingly, the vibration can be more reliably attenuated by the connection portion. Furthermore, the first struck portion or the second struck portion can be prevented from deformation or damage caused by the stress generated when the first struck portion or the second struck portion is struck.

According to an electronic pad of another technical solution of the present invention, in addition to the aforementioned effects, the following effects are obtained. At least one or more of the first upright portion, the second upright portion and the connection portion are formed thinner than the first struck portion and the second struck portion. Thus, the at least one or more parts bend more easily than the first struck portion and the second struck portion. That is, the vibration is more easily attenuated. Accordingly, the output difference between the first vibration sensor and the second vibration sensor can be further increased, and furthermore, the striking position can be correctly specified.

According to an electronic pad of another technical solution of the present invention, in addition to the aforementioned effects, the following effects are obtained. The connection portion is formed thinner than at least one of the first upright portion and the second upright portion. Thus, the connection portion bends more easily than the at least one of the first upright portion and the second upright portion. That is, the vibration is more easily attenuated. Accordingly, the output difference between the first vibration sensor and the second vibration sensor can be further increased, and furthermore, the striking position can be correctly specified.

According to an electronic pad of another technical solution of the present invention, in addition to the aforementioned effects, the following effects are obtained. The partitioning portion is integrally formed with and of the same material as a struck body. The partitioning portion may also be formed separately from the struck body and the two are later joined together. With respect to this, as described above, the partitioning portion is integrally formed with and of the same material as the struck body. Thus, number of members and assembling steps of the electronic pad can be reduced. Furthermore, rigidity of the electronic pad can be increased.

According to an electronic pad of another technical solution of the present invention, in addition to the aforementioned effects, the following effects are obtained. The partitioning portion is formed concentrically with the struck body in a plan view. Thus, the vibration transmitted in a radial direction can be uniformly attenuated over an entire circumference.

According to an electronic pad of another technical solution of the present invention, in addition to the aforementioned effects, the following effects are obtained. The upper surface of the first struck portion and the upper surface of the second struck portion are covered by a cover having higher elasticity than the first struck portion and the second struck portion. Thus, a percussion sound generated when an upper surface of the cover is struck can be reduced.

DESCRIPTION OF THE EMBODIMENTS

Figure 1A:
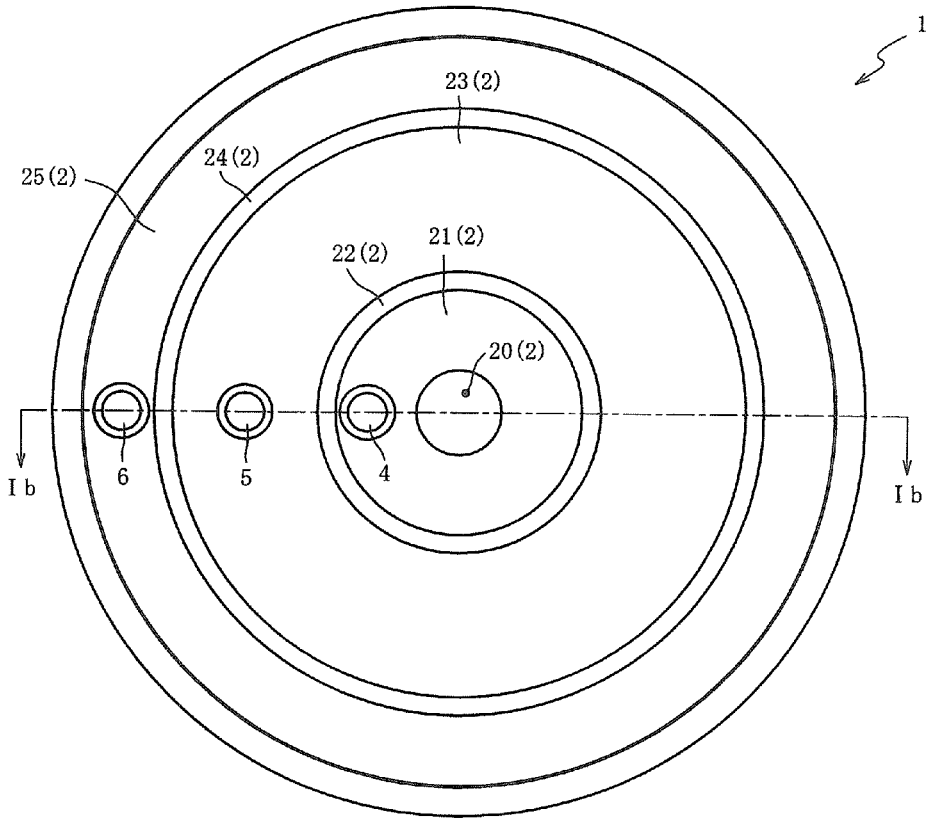
FIG. 1A is a bottom view of a cymbal pad according to the first embodiment.
Figure 1B:
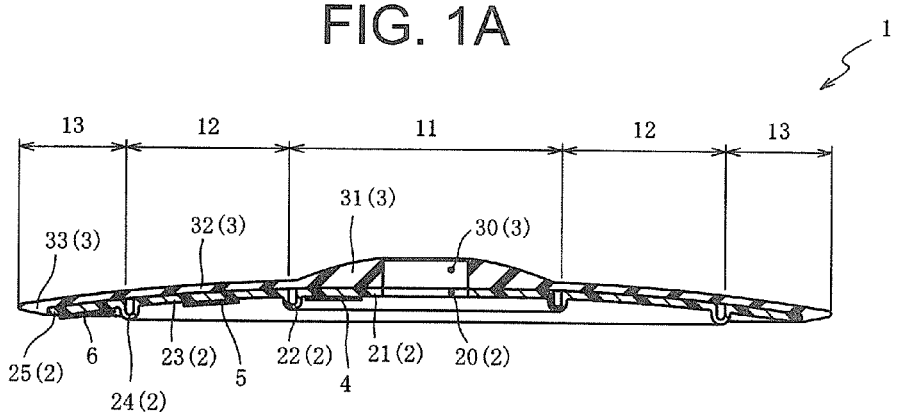
FIG. 1B is a cross-sectional view of the cymbal pad taken on section line Ib-Ib shown in FIG. 1A.

Preferred embodiments of the present invention are described hereinafter with reference to the accompanying drawings. First, a cymbal pad 1 according to the first embodiment is described with reference to FIG. 1A and FIG. 1B. FIG. 1A is a bottom view of the cymbal pad 1. FIG. 1B is a cross-sectional view of the cymbal pad 1 taken on section line Ib-Ib shown in FIG. 1A.

The cymbal pad 1 is partitioned into three parts denoted as 11, 12 and 13. Vibrations of the parts 11, 12 and 13 are detected by piezoelectric sensors 4, 5 and 6, respectively. Particularly, the cymbal pad 1 is capable of correctly specifying a striking position by increasing an output difference between adjacent piezoelectric sensors 4, 5 and 6. Moreover, the piezoelectric sensors 4, 5 and 6 are connected to a controller (not illustrated). The controller specifies the striking position according to the output difference between the adjacent piezoelectric sensors 4, 5 and 6, and outputs a musical sound corresponding to the specified striking position.

The cymbal pad 1 is formed in a flat dome shape. An upper surface of the cymbal pad 1 is configured as a circular struck head. As shown in FIG. 1B, the cymbal pad 1 is partitioned into three parts, namely, a bell portion 11, a bow portion 12 and an edge portion 13. The bell portion 11 is a central part of the cymbal pad 1. The bow portion 12 is a part surrounding the bell portion 11. The edge portion 13 is a part surrounding the bow portion 12. The bell portion 11 and the bow portion 12 are partitioned from each other by a first partitioning frame 22. The bow portion 12 and the edge portion 13 are partitioned from each other by a second partitioning frame 24. When the parts 11, 12 and 13 are struck, musical sounds respectively corresponding to the struck parts 11, 12 and 13 are outputted.

The cymbal pad 1 includes a frame 2, a cover 3, a bell sensor 4, a bow sensor 5 and an edge sensor 6. The cover 3 covers an upper surface of the frame 2. The bell sensor 4, the bow sensor 5 and the edge sensor 6 are each a piezoelectric sensor stuck to a bottom surface of the frame 2.

The frame 2 forms a framework of the cymbal pad 1. The frame 2 has a flat dome shape and is formed in a circular shape in a plan view. The frame 2 includes, from its center in a radial direction, the following parts: a bell frame 21, the first partitioning frame 22, a bow frame 23, the second partitioning frame 24 and an edge frame 25.

The parts of the frame 2 are each integrally molded of a hard resin material. The parts of the frame 2 may also be each separately molded and then joined together in a later step. With respect to this, as described above, the parts of the frame 2 are each integrally molded. Therefore, number of members and assembling steps of the frame 2 can be reduced. Furthermore, rigidity of the frame 2 can be improved. The resin material for forming the frame 2 includes, e.g., PP (polypropylene), PA (polyamide), FRP (fiber-reinforced plastic), etc. Moreover, the frame 2 may be formed not only of resin but may also be formed of metal such as bronze, iron, stainless steel, etc.

The bell frame 21 is a central part of the frame 2. The bell frame 21 forms a framework of the bell portion 11. A through hole 20 passes through the center of the bell frame 21. A shaft support member (not illustrated) is installed into the through hole 20. The cymbal pad 1 is installed to be swingable with respect to a shaft supported by the shaft support member.

The first partitioning frame 22 is a part surrounding the bell frame 21. The first partitioning frame 22 is formed concentrically with the frame 2 and is formed in a U shape in a cross-sectional view. The bow frame 23 is a part surrounding the first partitioning frame 22. The bow frame 23 forms a framework of the bow portion 12. The second partitioning frame 24 is a part surrounding the bow frame 23. The second partitioning frame 24 is formed concentrically with the frame 2 and is formed in a U shape in a cross-sectional view. The edge frame 25 is a part surrounding the second partitioning frame 24. The edge frame 25 forms a framework of the edge portion 13.

In this manner, the bell frame 21 and the bow frame 23 are partitioned from each other by the first partitioning frame 22 formed in a U shape in a cross-sectional view. Hence, a vibration transmitted between the bell frame 21 and the bow frame 23 is transmitted by the first partitioning frame 22 along a detour route U-shaped in cross-section. That is, the vibration transmitted between the bell frame 21 and the bow frame 23 is transmitted while its direction is being changed and is transmitted through a longer distance from one side to the other side, as compared to a circumstance in which the vibration is transmitted through a direct transmission between the bell frame 21 and the bow frame 23. Accordingly, the vibration can be attenuated by the first partitioning frame 22. In addition, the first partitioning frame 22 is formed concentrically with the frame 2. Thus, the vibration transmitted between the bell frame 21 and the bow frame 23 in the radial direction can be uniformly attenuated over an entire circumference.

Furthermore, the bow frame 23 and the edge frame 25 are partitioned from each other by the second partitioning frame 24 formed in a U shape in a cross-sectional view. Hence, a vibration transmitted between the bow frame 23 and the edge frame 25 is transmitted by the second partitioning frame 24 along a detour route U-shaped in cross-section. That is, the vibration transmitted between the bow frame 23 and the edge frame 25 is transmitted while its direction is being changed and is transmitted through a longer distance from one side to the other side, as compared to a circumstance in which the vibration is transmitted through a direct transmission between the bow frame 23 and the edge frame 25. Accordingly, the vibration can be attenuated by the second partitioning frame 24. In addition, the second partitioning frame 24 is formed concentrically with the frame 2. Thus, the vibration transmitted between the bow frame 23 and the edge frame 25 in the radial direction can be uniformly attenuated over the entire circumference.

Figure 2A:
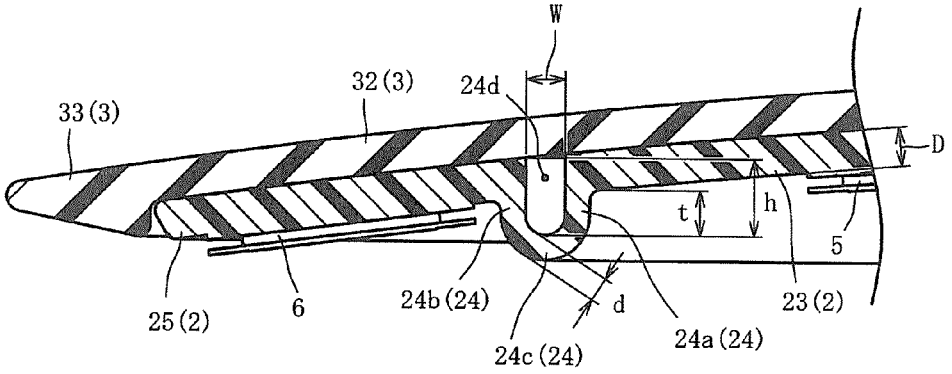
FIG. 2A is an enlarged cross-sectional view of a second partitioning frame.

FIG. 2A is an enlarged cross-sectional view of the second partitioning frame 24. Here, the second partitioning frame 24 is described in detail with reference to FIG. 2A. Moreover, since the first partitioning frame 22 is configured in the same manner as the second partitioning frame 24, a detailed description thereof will be omitted.

The second partitioning frame 24 is formed in a U shape in a cross-sectional view by a first upright portion 24*a*, a second upright portion 24*b* and a connection portion 24*c*. The connection portion 24*c* is connected to the first upright portion 24*a* and the second upright portion 24*b*. In other words, the second partitioning frame 24 forms a groove 24*d* surrounded by the first upright portion 24*a*, the second upright portion 24*b* and the connection portion 24*c*.

The first upright portion 24*a* is a part hanging down from a rear surface of the bow frame 23. The second upright portion 24*b* is a part spaced apart from the first upright portion 24*a* and hanging down from a bottom surface of the edge frame 25. The connection portion 24*c* is connected between an end portion of the first upright portion 24*a* and an end portion of the second upright portion 24*b*. Furthermore, the connection portion 24*c* is a part formed in an arc shape expanding toward a side opposite the cover 3.

In this manner, the first upright portion 24*a* protrudes from the bow frame 23, and the second upright portion 24*b* protrudes from the edge frame 25. Thus, in the bow frame 23 and the edge frame 25, particularly parts where the first upright portion 24*a* and the second upright portion 24*b* protrude have higher rigidity than the connection portion 24*c*. That is, the bow frame 23 including the first upright portion 24*a* and the edge frame 25 including the second upright portion 24*b* approach a state of being elastically supported by the connection portion 24*c*. Thus, the vibration transmitted between the bow frame 23 and the edge frame 25 can be attenuated by the connection portion 24*c*.

In addition, the connection portion 24*c* is connected between the end portion of the first upright portion 24*a* and the end portion of the second upright portion 24*b*. Thus, compared to a case where the connection portion 24*c* is connected between an intermediate position on the first upright portion 24*a* and an intermediate position on the second upright portion 24*b*, the distance that the vibration is transmitted between the bow frame 23 and the edge frame 25 can be increased. Furthermore, the rigidity of the connection portion 24*c* can be much lower than the rigidity of the bow frame 23 and the edge frame 25. Thus, the vibration can be more reliably attenuated by the connection portion 24*c*.

In addition, the second partitioning frame 24 may also be formed in a V shape in a cross-sectional view. However, in this case, if the struck head is struck, stress concentrates on a V-shaped bent portion. With respect to this, the connection portion 24*c* of the second partitioning frame 24 is formed in an arc shape expanding in an opposite direction from the struck head. Accordingly, the stress is dispersed. That is, the rigidity of the connection portion 24*c* can be further reduced. Thus, the vibration can be more reliably attenuated by the connection portion 24*c*. Furthermore, the bow frame 23 or the edge frame 25 can be prevented from deformation or damage caused by the stress that results from the striking on the struck head.

Furthermore, the second partitioning frame 24 constituted by the first upright portion 24*a*, the second upright portion 24*b* and the connection portion 24*c* is located opposite the struck head. Thus, the second partitioning frame 24 can be prevented from obstructing the playing.

In addition, the first upright portion 24*a*, the second upright portion 24*b* and the connection portion 24*c* are formed having almost the same wall thickness d (hereafter the "wall thickness d of the second partitioning frame 24"). In the frame 2, the bow frame 23 and the edge frame 25 are formed having almost the same wall thickness D (hereafter the "wall thickness D of the frame 2"). Here, the wall thickness d of the second partitioning frame 24 is thinner than the wall thickness D of the frame 2.

Hence, the second partitioning frame 24 bends more easily than the bow frame 23 and the edge frame 25. Thus, the vibration transmitted between the bow frame 23 and the edge frame 25 is easily buffered by the second partitioning frame 24. That is, the vibration can be easily attenuated by the second partitioning frame 24.

A length of the first upright portion 24*a* from the rear surface of the bow frame 23 to an inner surface of the connection portion 24*c* (the most recessed surface of the inner surface of the connection portion 24*c*) is a length t (hereafter the "height t of the first upright portion 24*a*"). Here, the height t of the first upright portion 24*a* is a little longer than the wall thickness D of the frame 2. Moreover, a length of the second upright portion 24*b* from a rear surface of the edge frame 25 to the inner surface of the connection portion 24*c* (the most recessed surface of the inner surface of the connection portion 24*c*) is a little shorter than the height t of the first upright portion 24*a*.

A gap of the groove 24*d* between an inner surface of the first upright portion 24*a* and an inner surface of the second upright portion 24*b* is a width w (hereafter the "width w of the groove 24*d*"). The width w of the groove 24*d* is almost as long as the wall thickness D of the frame 2. A depth of the groove 24*d* from an opening end of the frame 2 toward the cover 3 to the inner surface of the connection portion 24*c* (the most recessed surface of the inner surface of the connection portion 24*c*) is a depth h (hereafter the "depth h of the groove 24*d*"). The depth h of the groove 24*d* is almost twice as long as the wall thickness D of the frame 2.

That is, due to the second partitioning frame 24, the vibration transmitted between the bow frame 23 and the edge frame 25 is transmitted in a bending manner through a distance about three times the wall thickness D of the frame 2. Thus, the vibration can be transmitted while being attenuated by the second partitioning frame 24. Moreover, the sizes (lengths and wall thicknesses) of the first upright portion 24*a*, the second upright portion 24*b*, the connection portion 24*c* and the groove 24*d* are not limited to the aforementioned sizes.

The explanation is continued by referring back to FIG. 1B. The cover 3 includes, from its center in the radial direction, a dome portion 31, a flat portion 32 and a hook portion 33. The flat portion 32 surrounds the dome portion 31. The hook portion 33 surrounds the flat portion 32. The cover 3 is composed of a resin material having higher elasticity than the frame 2. Hence, a percussive sound generated when the cover 3 is struck can be reduced. The material for composing the cover 3 is not limited to a resin material, but may also be, e.g., synthetic rubber, thermoplastic elastomer (TPE), polyvinyl chloride (PVC), or a foaming material, etc.

The dome portion 31 is a part covering the bell frame 21. The dome portion 31 is formed in a dome shape expanding toward a central upper side of the dome portion 31. A through hole 30 passing through the through hole 20 of the bell frame 21 passes through a center of the dome portion 31. The shaft support member is inserted into the through hole 30. The flat portion 32 is a part covering the bow frame 23 and the edge frame 25. The flat portion 32 is formed flat, having an almost uniform thickness (wall thickness). The hook portion 33 is a part bending from an end portion of the flat portion 32 toward the frame 2. The cover 3 is crimped onto the frame 2 by having the hook portion 33 hooked on an edge of the frame 2.

The bell sensor 4, the bow sensor 5 and the edge sensor 6 are each configured as a piezoelectric sensor electrically detecting a vibration by a piezoelectric element. Compared to a sheet sensor, the piezoelectric sensor is capable of also detecting striking intensity. Thus, the piezoelectric sensor easily outputs a natural musical sound corresponding to the performer's performance expression. Furthermore, the piezoelectric sensor is cheap and thus capable of reducing costs for members.

The bell sensor 4 is stuck to a rear surface of the bell frame 21 to detect the vibration of the bell frame 21. The bow sensor 5 is stuck to the rear surface of the bow frame 23 to detect the vibration of the bow frame 23. The edge sensor 6 is stuck to the rear surface of the edge frame 25 to detect the vibration of the edge frame 25. Moreover, the bell sensor 4, the bow sensor 5 and the edge sensor 6 are connected to the controller (not illustrated). The controller specifies the striking position according to an output difference between adjacent piezoelectric sensors, and outputs a musical sound corresponding to the specified striking position.

According to the cymbal pad 1, the striking position can be correctly specified. For example, when the edge portion 13 (an upper surface of the cover 3 included in the edge portion 13) is struck, a vibration is transmitted from the edge frame 25 to the bow frame 23 through the second partitioning frame 24. The vibration transmitted from the edge frame 25 to the bow frame 23 is transmitted while being attenuated by the second partitioning frame 24. Hence, an output difference between an output of the edge sensor 6 (i.e., the vibration of the edge frame 25 detected by the edge sensor 6) and an output of the bow sensor 5 (i.e., the vibration of the bow frame 23 detected by the bow sensor 5) can be increased. Accordingly, the striking position can be correctly specified by use of the edge sensor 6 and the bow sensor 5.

Similarly, when the bell portion 11 is struck, a vibration is transmitted from the bell frame 21 to the bow frame 23 through the first partitioning frame 22. The vibration transmitted from the bell frame 21 to the bow frame 23 is transmitted while being attenuated by the first partitioning frame 22. Hence, an output difference between an output of the bell sensor 4 (i.e., the vibration of the bell frame 21 detected by the bell sensor 4) and the output of the bow sensor 5 (i.e., the vibration of the bow frame 23 detected by the bow sensor 5) can be increased. Accordingly, the striking position can be correctly specified by use of the bell sensor 4 and the bow sensor 5.

Moreover, when the bow portion 12 is struck, the output of the bow sensor 5 may be compared to the output of the bell sensor 4 or the output of the edge sensor 6.

Next, with reference to FIG. 2B, FIG. 2C, FIG. 3A and FIG. 3B, variants of the second partitioning frame 24 are described. Moreover, the variants of the second partitioning frame 24 described below may also apply to the first partitioning frame 22.

Figure 2B:
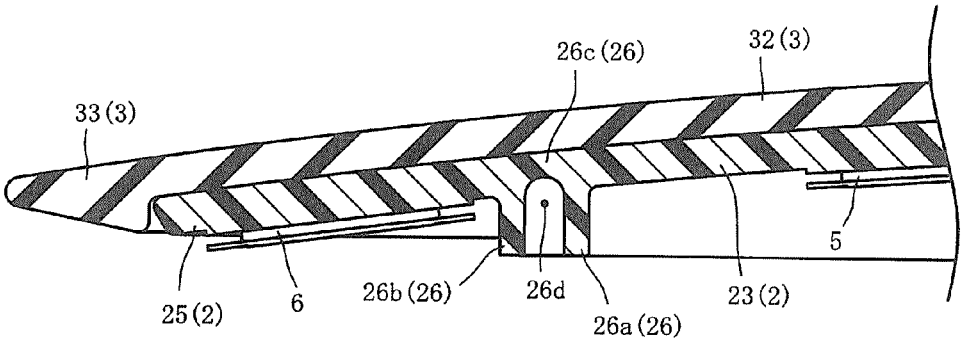
FIG. 2B is an enlarged cross-sectional view illustrating a first variant of the second partitioning frame.

FIG. 2B is an enlarged cross-sectional view illustrating a first variant of the second partitioning frame 24. Particularly, a second partitioning frame 26 of the first variant is obtained by changing the shape of the connection portion 24*c* of the second partitioning frame 24 shown in FIG. 2A.

In the second partitioning frame 26 of the first variant, a connection portion 26*c* is connected between an end portion of a first upright portion 26*a* toward the cover 3 and an end portion of the second upright portion 26*b* toward the cover 3. An inner surface of the connection portion 26*c* is formed in an arc shape bending toward the cover 3. Furthermore, the connection portion 26*c* is formed having a wall thickness thinner than the wall thickness of the frame 2.

That is, the first upright portion 26*a* protrudes from the bow frame 23, and the second upright portion 26*b* protrudes from the edge frame 25. Thus, in the bow frame 23 and the edge frame 25, particularly parts where the first upright portion 26*a* and the second upright portion 26*b* protrude have higher rigidity than the connection portion 26*c* connected to the first upright portion 26*a* and the second upright portion 26*b*. That is, the bow frame 23 including the first upright portion 26*a* and the edge frame 25 including the second upright portion 26*b* approach a state of being elastically supported by the connection portion 26*c*. Hence, the vibration transmitted between the bow frame 23 and the edge frame 25 is transmitted while being attenuated by the connection portion 26*c* of the second partitioning frame 26.

Moreover, the wall thickness of the connection portion 26*c* is thinner than the wall thickness of the frame 2. Thus, the connection portion 26*c* bends more easily than the frame 2. Hence, the vibration is transmitted after being buffered and attenuated by the connection portion 26*c*. Thus, the output difference between the output of the edge sensor 6 and the output of the bow sensor 5 can be increased. Accordingly, the striking position can be correctly specified by use of the edge sensor 6 and the bow sensor 5.

In addition, a surface of the connection portion 26*c* toward the cover 3 is formed continuously flat between a surface of the bow frame 23 toward the cover 3 and a surface of the edge frame 25 toward the cover 3. Hence, as in the second partitioning frame 24 shown in FIG. 2A, a space is formed between the bow frame 23 and the edge frame 25, and this space can alleviate a sense of incongruity when striking is performed through the cover 3.

Figure 2C:
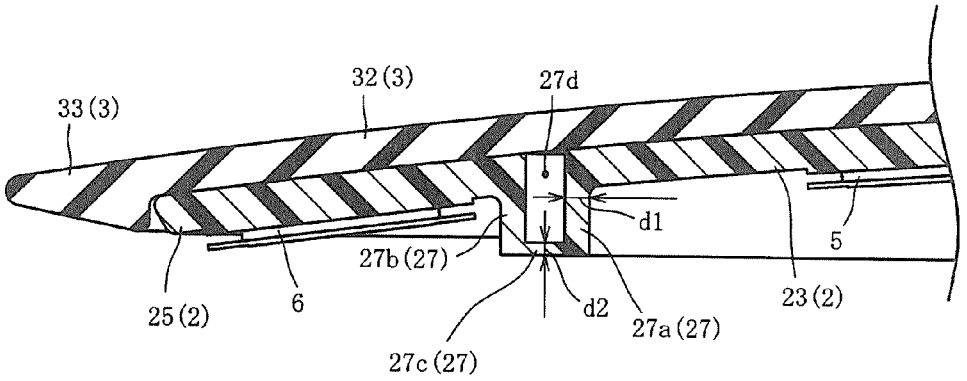
FIG. 2C is an enlarged cross-sectional view illustrating a second variant of the second partitioning frame.

FIG. 2C is an enlarged cross-sectional view of a second partitioning frame 27 of a second variant. Particularly, the second partitioning frame 27 of the second variant is obtained by reducing the wall thickness of the connection portion 24*c* of the second partitioning frame 24 shown in FIG. 2A. That is, in the second partitioning frame 27 of the second variant, a wall thickness d2 of a connection portion 27*c* is formed thinner than a wall thickness d1 of a first upright portion 27*a* and of a second upright portion 27*b*. Hence, the connection portion 27*c* of the second partitioning frame 27 bends more easily than the connection portion 24*c* of the second partitioning frame 24 shown in FIG. 2A. That is, a vibration attenuation effect can be improved.

In addition, the connection portion 27*c* is formed in a linear shape in a cross-sectional view. In this case, rigidity of the connection portion 27*c* can be reduced compared to a case where the second partitioning frame 27 is formed into a V shape in a cross-sectional view by directly connecting an end portion of the first upright portion 27*a* to an end portion of the second upright portion 27*b*. In the case where the second partitioning frame 27 has a V shape in a cross-sectional view, if the struck head is struck, the stress concentrates on the one V-shaped bent portion. With respect to this, as described above, there are two bent portions formed in the second partitioning frame 27. One of the bent portions is a connecting part between the end portion of the first upright portion 27*a* and an end portion of the connection portion 27*c*. The other is a connecting part between the end portion of the second upright portion 27*b* and the end portion of the connection portion 27*c*. Hence, when the struck head is struck, the stress is dispersed to these two bent portions. Thus, the vibration can be more reliably attenuated by the connection portion 27*c*. Furthermore, the bow frame 23 or the edge frame 25 can be prevented from deformation or damage caused by the stress that results from the striking on the struck head.

Figure 3A:
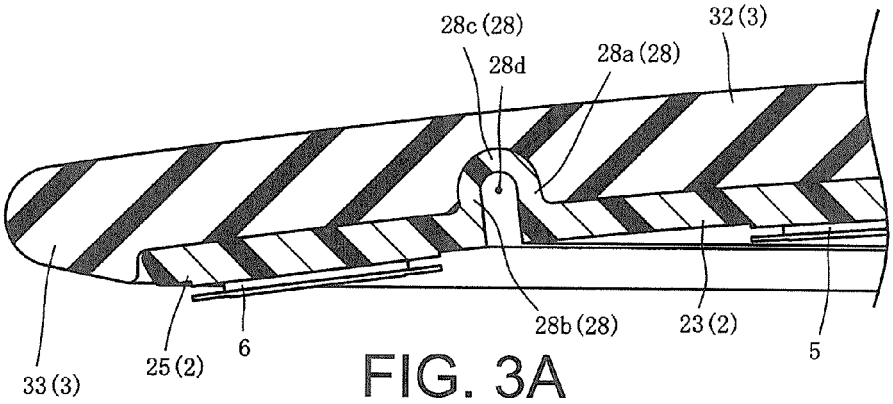
FIG. 3A is an enlarged cross-sectional view illustrating a third variant of the second partitioning frame.

FIG. 3A is an enlarged cross-sectional view of a second partitioning frame 28 of a third variant. In contrast to the second partitioning frame 24 shown in FIG. 2A, the second partitioning frame 28 of the third variant is formed in a reverse U shape in a cross-sectional view. In the second partitioning frame 28, a first upright portion 28*a* and a second upright portion 28*b* extend above the upper surface of the frame 2 (the surface of the frame 2 toward the cover 3). A connection portion 28*c* is connected to an end portion of the first upright portion 28*a* and an end portion of the second upright portion 28*b*, the end portions both being above the upper surface of the frame 2.

The second partitioning frame 28 merely differs from the second partitioning frame 24 shown in FIG. 2A in a path (direction) in which the vibration is transmitted between the edge frame 25 and the bow frame 23. Thus, similarly to the second partitioning frame 24 shown in FIG. 2A, the second partitioning frame 28 is capable of attenuating the vibration transmitted between the edge frame 25 and the bow frame 23.

Moreover, as described above, the second partitioning frame 28 protrudes above the upper surface of the frame 2 (the surface of the frame 2 toward the cover 3). Thus, the cover 3 covering the second partitioning frame 28 has a thickness thicker than that of the cover 3 shown in FIG. 2A. In addition, the second partitioning frame 28 is covered by the cover 3. Thus, a vibration of the second partitioning frame 28 is restricted by the cover 3, and the vibration attenuation effect by means of the second partitioning frame 28 may be alleviated. In this case, some clearance may be provided between the second partitioning frame 28 and the cover 3.

Figure 3B:
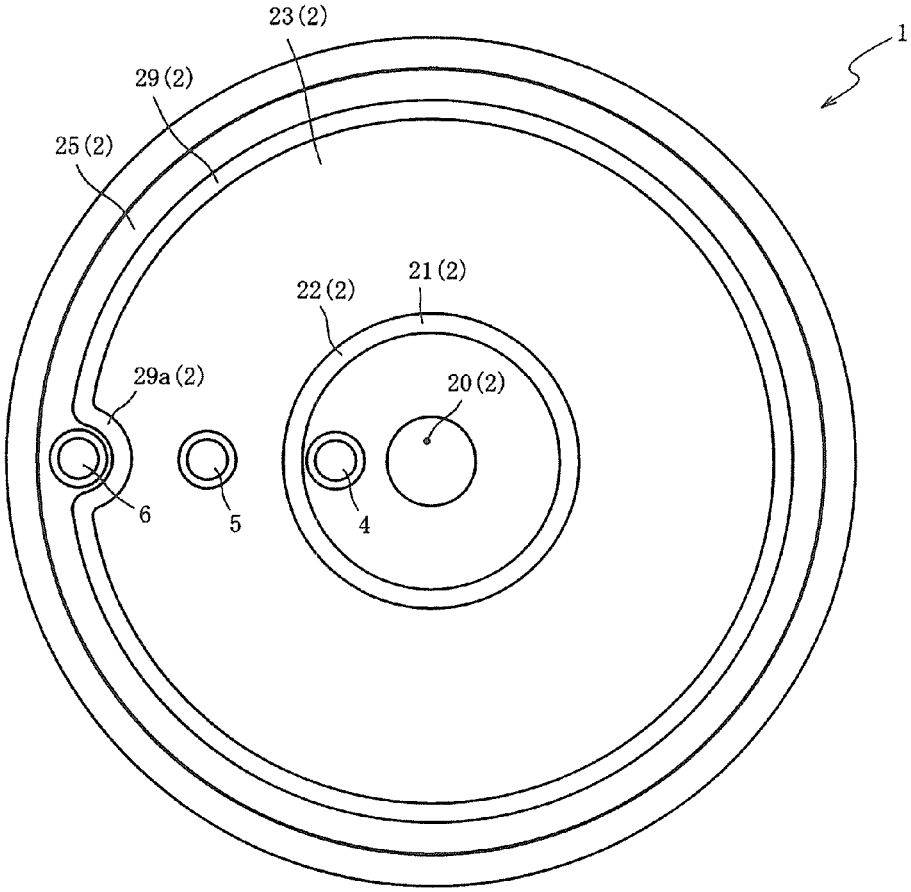
FIG. 3B is a bottom view of a cymbal pad illustrating a fourth variant of the second partitioning frame.

FIG. 3B is a bottom view of the cymbal pad 1 provided with a second partitioning frame 29 of a fourth variant. The second partitioning frame 29 of the fourth variant has a diameter greater than that of the second partitioning frame 24 shown in FIG. 1A. Furthermore, an avoiding portion 29*a* for avoiding the edge sensor 6 is provided at an intermediate position on the second partitioning frame 29.

In the cymbal pad 1 shown in FIG. 3B, the bow frame 23 is wider and the edge frame 25 is narrower than in the cymbal pad 1 shown in FIG. 1A. Hence, if the edge sensor 6 of the same size as the edge sensor 6 shown in FIG. 1A is used, the second partitioning frame 29 overlaps the edge sensor 6. Accordingly, the avoiding portion 29*a* for avoiding the edge sensor 6 is provided at an intermediate position on the second partitioning frame 29.

The second partitioning frame 29 is not formed concentrically with the frame 2, and partitions the bow frame 23 and the edge frame 25 from each other. Hence, by the second partitioning frame 29, the vibration transmitted between the bow frame 23 and the edge frame 25 can be attenuated and transmitted in the same manner as by the second partitioning frame 24 shown in FIG. 1A. That is, it is not necessary that the second partitioning frame 24 shown in FIG. 1A be formed concentrically with the frame 2. It is satisfactory as long as the second partitioning frame 24 partitions at least two striking parts from each other.

Figure 4A:
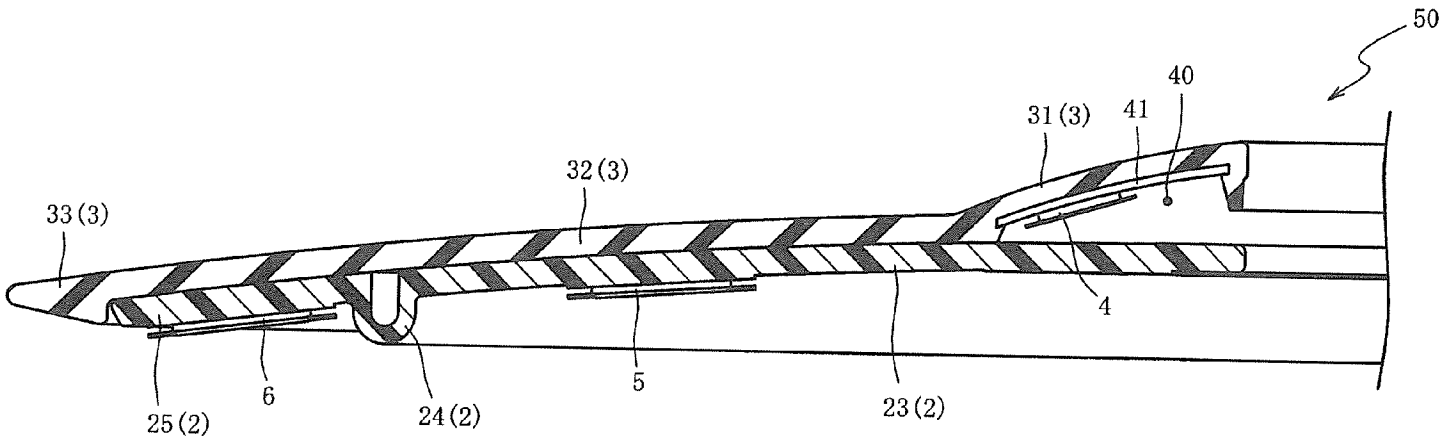
FIG. 4A is a partial cross-sectional view illustrating a first variant of the cymbal pad.

Next, variants of the cymbal pad 1 are described with reference to FIG. 4A and FIG. 4B. FIG. 4A is a partial cross-sectional view of a cymbal pad 50 of a first variant. Particularly, the cymbal pad 50 of the first variant is obtained by removing the first partitioning frame 22 from the cymbal pad 1 shown in FIG. 1A and changing the position where the bell sensor 4 is attached.

In the cymbal pad 50 of the first variant, a space 40 is formed inside the dome portion 31 of the cover 3. A steel plate 41 is stuck to an inner surface of the dome portion 31. The bell sensor 4 is stuck to the steel plate 41 to detect a vibration of the steel plate 41. Accordingly, in the cymbal pad 50 of the first variant, the steel plate 41 of which the vibration is detected by the bell sensor 4 and the bow frame 23 of which the vibration is detected by the bow sensor 5 can be separated from each other. Thus, the output difference between the output of the bell sensor 4 and the output of the bow sensor 5 can be increased. Accordingly, without a component equivalent to the first partitioning frame 22, the striking position can still be correctly specified by use of the bell sensor 4 and the bow sensor 5.

Figure 4B:
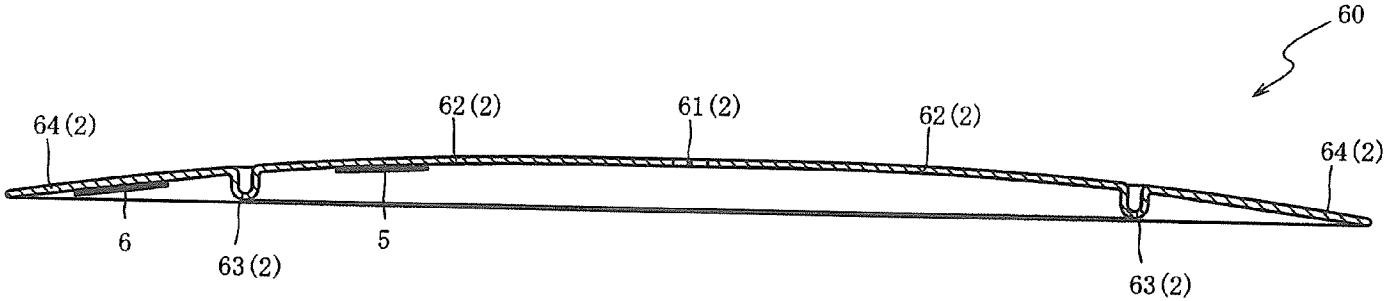
FIG. 4B is a cross-sectional view illustrating a second variant of the cymbal pad.

FIG. 4B is a cross-sectional view of a cymbal pad 60 of a second variant. The cymbal pad 60 of the second variant is of a type made of metal and having no cover for covering the frame 2. In addition, the upper surface of the frame 2 is configured as the struck head. The cymbal pad 60 of the second variant includes the frame 2, the bow sensor 5 and the edge sensor 6. The bow sensor 5 and the edge sensor 6 are stuck to the bottom surface of the frame 2.

The frame 2 has a flat dome shape and is formed in a circular shape in a plan view. The frame 2 includes a shaft insertion hole 61, a bow frame 62, a second partitioning frame 63 and an edge frame 64. The shaft insertion hole 61 passes through a center of the frame 2. The bow frame 62 surrounds the shaft insertion hole 61. The second partitioning frame 63 surrounds the bow frame 62. The edge frame 64 surrounds the second partitioning frame 63. That is, the cymbal pad 60 is partitioned into two parts by the second partitioning frame 63. The second partitioning frame 63 is equivalent to the second partitioning frame 24 of the cymbal pad 1. Hence, in the cymbal pad 60, the vibration transmitted between the bow frame 62 and the edge frame 64 can be attenuated by the second partitioning frame 63. Accordingly, the striking position can be correctly specified by use of the edge sensor 6 and the bow sensor 5. That is, with respect to the cymbal pad, a cover may be present or omitted. Furthermore, it is preferable as long as the cymbal pad is partitioned into two or more parts.

Figures 5A, 5B, 5C:
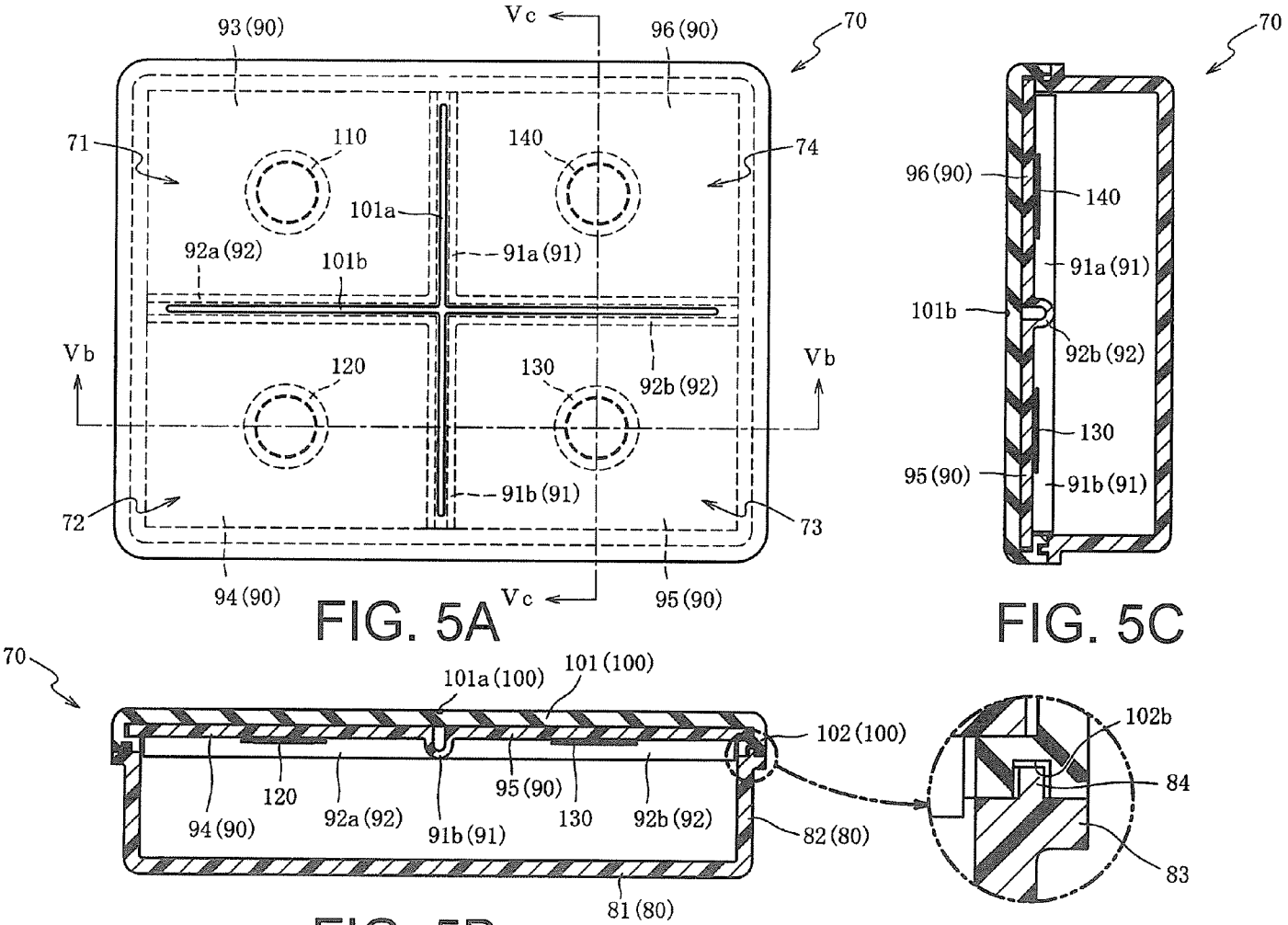
FIG. 5A is a plan view of a drum pad according to the second embodiment.
FIG. 5B is a cross-sectional view of the drum pad taken on section line Vb-Vb shown in FIG. 5A.
FIG. 5C is a cross-sectional view of the drum pad taken on section line Vc-Vc shown in FIG. 5A.

Next, a drum pad according to the second embodiment of the present invention is described with reference to FIG. 5A to FIG. 5C. FIG. 5A is a plan view of a drum pad 70. FIG. 5B is a cross-sectional view of the drum pad 70 taken on section line Vb-Vb in FIG. 5A. FIG. 5C is a cross-sectional view of the drum pad 70 taken on section line Vc-Vc in FIG. 5A.

The drum pad 70 is partitioned into four parts denoted as 71, 72, 73 and 74. Vibrations of the parts 71, 72, 73 and 74 are detected by piezoelectric sensors 110, 120, 130 and 140, respectively. Particularly, an output difference between adjacent piezoelectric sensors 110, 120, 130 and 140 is increased so that a striking position can be correctly specified. Moreover, the piezoelectric sensors 110, 120, 130 and 140 are connected to a controller (not illustrated). The controller specifies the striking position according to the output difference between the adjacent piezoelectric sensors, and outputs a musical sound corresponding to the specified striking position.

The drum pad 70 is formed in a flat box shape. An upper surface of the drum pad 70 is configured as a rectangular struck head. A rectangular frame 90 forming a framework of the struck head of the drum pad 70 is partitioned into four parts by a vertical frame 91 and a horizontal frame 92. The frame 90 is divided by the vertical frame 91 into two equal parts in a long-side direction (a left-right direction in FIG. 5A). The frame 90 is divided by the horizontal frame 92 into two equal parts in a short-side direction (an up-down direction in FIG. 5B).

The drum pad 70 is partitioned into the following four parts with the vertical frame 91 and the horizontal frame 92 as boundaries: a first pad portion 71, a second pad portion 72, a third pad portion 73 and a fourth pad portion 74. When the pad portions 71, 72, 73 and 74 are struck, musical sounds respectively corresponding to the struck parts 71, 72, 73 and 74 are outputted.

In the drum pad 70, the vertical frame 91 and the horizontal frame 92 are equivalent to the first partitioning frame 22 and the second partitioning frame 24 of the cymbal pad 1 (see FIG. 1A and FIG. 1B) of the first embodiment. That is, in the drum pad 70, by the vertical frame 91 and the horizontal frame 92, the vibrations transmitted between each two adjacent pad portions can be attenuated.

The drum pad 70 includes a housing 80, a frame 90, a cover 100, a first sensor 110, a second sensor 120, a third sensor 130 and a fourth sensor 140. The housing 80 has an opened upper surface. The frame 90 covers the opened surface of the housing 80. The cover 100 covers the frame 90. The first sensor 110, the second sensor 120, the third sensor 130 and the fourth sensor 140 are piezoelectric sensors stuck to a rear surface of the frame 90.

The housing 80 supports the frame 90 covered by the cover 100. The housing 80 is formed in a hollow box shape. The housing 80 includes a bottom wall 81, a side wall 82 and a flange 83. The side wall 82 extends from an outer edge of the bottom wall 81. The flange 83 bends outward from an upper end of the side wall 82. A protrusion 84 projects from an upper surface of the flange 83. A concave groove 102*b* of the cover 100 is fitted to the protrusion 84.

The frame 90 is formed in a rectangular shape in a plan view. The frame 90 is partitioned into four frames (a first frame 93, a second frame 94, a third frame 95 and a fourth frame 96) by the vertical frame 91 and the horizontal frame 92 intersecting in a cross shape.

The vertical frame 91 is formed in a U shape in a cross-sectional view. The vertical frame 91 includes a first vertical frame 91*a* (on the upper side in FIG. 5A) and a second vertical frame 91*b* (on the lower side in FIG. 5B) with a part intersecting the horizontal frame 92 as a boundary. The first vertical frame 91*a* is interposed between the first frame 93 and the fourth frame 96 to attenuate a vibration transmitted between the first frame 93 and the fourth frame 96. The second vertical frame 91*b* is interposed between the second frame 94 and the third frame 95 to attenuate a vibration transmitted between the second frame 94 and the third frame 95.

The horizontal frame 92 is formed in a U shape in a cross-sectional view. The horizontal frame 92 includes a first horizontal frame 92*a* (on the left side in FIG. 5A) and a second horizontal frame 92*b* (on the right side in FIG. 5A) with a part intersecting the vertical frame 91 as a boundary. The first horizontal frame 92*a* is interposed between the first frame 93 and the second frame 94 to attenuate a vibration transmitted between the first frame 93 and the second frame 94. The second horizontal frame 92*b* is interposed between the third frame 95 and the fourth frame 96 to attenuate a vibration transmitted between the third frame 95 and the fourth frame 96.

Moreover, the vertical frame 91 and the horizontal frame 92 are equivalent to the first partitioning frame 22 and the second partitioning frame 24 of the cymbal pad 1 (see FIG. 1A and FIG. 1B) of the first embodiment. Since the vertical frame 91 and the horizontal frame 92 are configured in the same manner as the first partitioning frame 22 and the second partitioning frame 24, a detailed description thereof will be omitted.

The cover 100 includes a main body portion 101 and a hook portion 102. The hook portion 102 is connected with an outer edge of the main body portion 101. The cover 100 is composed of a resin material having higher elasticity than the frame 2. Thus, a percussive sound generated when the struck head is struck can be reduced.

The main body portion 101 is a part covering an upper surface of the frame 90. The main body portion 101 has a plate shape and is formed in a rectangular shape in a plan view. A vertical groove 101*a* is formed at a position on the main body portion 101 where the vertical groove 101*a* overlaps the vertical frame 91. Furthermore, a horizontal groove 101*b* is formed at a position on the main body portion 101 where the horizontal groove 101*b* overlaps the horizontal frame 92. The performer can recognize positions of the first pad portion 71, the second pad portion 72, the third pad portion 73 and the fourth pad portion 74 according to the vertical groove 101*a* and the horizontal groove 101*b*.

The hook portion 102 is a part hanging down from the outer edge of the main body portion 101 and bending inward. The frame 90 is sandwiched between the main body portion 101 and the hook portion 102 and crimped to the cover 100. The concave groove 102*b* is depressed on a surface of the hook portion 102 opposed to the flange 83 of the housing 80. The protrusion 84 protruding from the flange 83 is fitted into the concave groove 102*b*. Accordingly, the frame 90 is fixed to the housing 80 through the cover 100.

All of the first sensor 110, the second sensor 120, the third sensor 130 and the fourth sensor 140 are piezoelectric sensors. The first sensor 110 is stuck to a center of a rear surface of the first frame 93 to detect a vibration of the first frame 93. The second sensor 120 is stuck to a center of a rear surface of the second frame 94 to detect a vibration of the second frame 94. The third sensor 130 is stuck to a center of a rear surface of the third frame 95 to detect a vibration of the third frame 95. The fourth sensor 140 is stuck to a center of a rear surface of the fourth frame 96 to detect a vibration of the fourth frame 96.

According to the drum pad 70, the striking position can be correctly specified. For example, when the first pad portion 71 (an upper surface of the cover 100 included in the first pad portion 71) is struck, the vibration transmitted from the first frame 93 to the second frame 94 is attenuated by the first horizontal frame 92*a*. Hence, an output difference between an output of the first sensor 110 (i.e., the vibration of the first frame 93 detected by the first sensor 110) and an output of the second sensor 120 (i.e., the vibration of the second frame 94 detected by the second sensor 120) can be increased. Accordingly, the striking position can be correctly specified by use of the first sensor 110 and the second sensor 120.

Moreover, in the above examples, descriptions have been given of the case where the output of the first sensor 110 and the output of the second sensor 120 are compared to each other. However, it is satisfactory as long as the sensors to be compared are sensors attached to adjacent pads. That is, in the above examples, the output of the first sensor 110 may also be compared to the output of the fourth sensor 140.

Figure 6C:
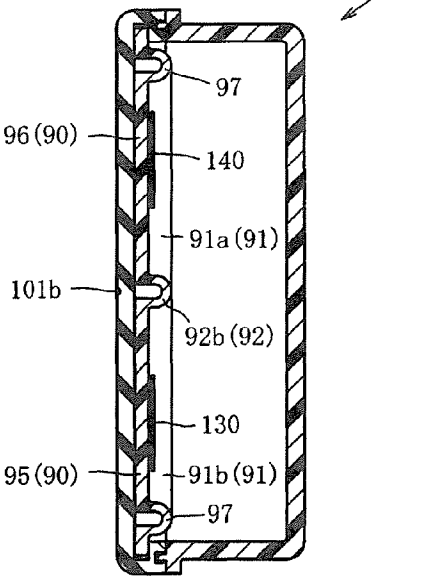
FIG. 6C is a cross-sectional view of the drum pad taken on section line VIc-VIc shown in FIG. 6A.
Figure 6A:
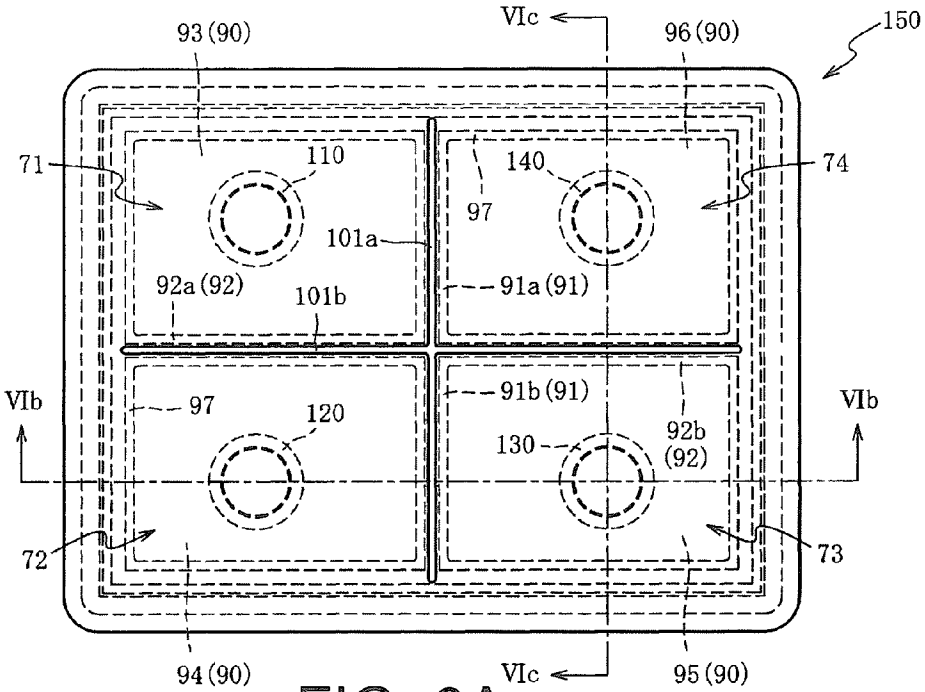
FIG. 6A is a plan view illustrating a first variant of the drum pad.
Figure 6B:
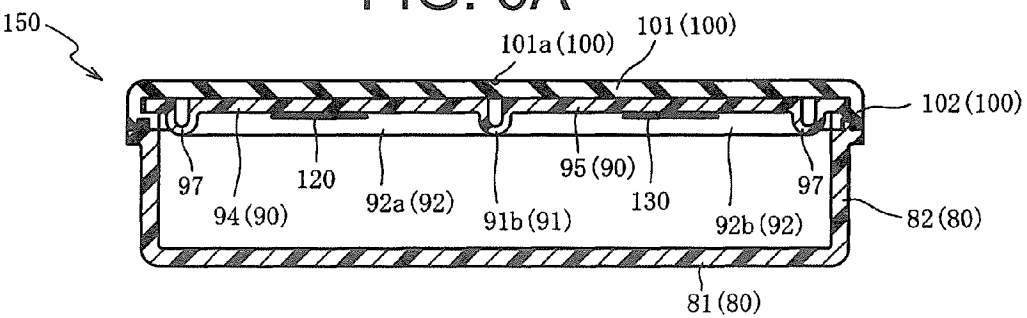
FIG. 6B is a cross-sectional view of the drum pad taken on section line VIb-VIb shown in FIG. 6A.

Next, a drum pad 150 as a variant of the drum pad 70 is described with reference to FIG. 6A to FIG. 6C. FIG. 6A is a plan view of the drum pad 150. FIG. 6B is a cross-sectional view of the drum pad 150 taken on section line VIb-VIb in FIG. 6A. FIG. 6C is a cross-sectional view of the drum pad 150 taken on section line VIc-VIc in FIG. 6A. Moreover, components in common with the drum pad 70 are denoted by the same reference numerals and descriptions thereof will be omitted.

In contrast to the drum pad 70, the drum pad 150 is provided with an outer edge frame 97. The outer edge frame 97 attenuates a vibration transmitted to an outer edge of the frame 90. The outer edge frame 97 is a portion of the frame 90. The outer edge frame 97 is provided a little inward of and along the outer edge of the frame 90 on an entire circumference of the frame 90. Similarly to the vertical frame 91 and the horizontal frame 92, the outer edge frame 97 is formed in a U shape in a cross-sectional view.

Hence, if the struck head is struck, the vibration transmitted toward the outer edge of the frame 90 is transmitted while being attenuated by the outer edge frame 97. Accordingly, the following problem can be suppressed: due to the vibration of the outer edge of the frame 90, fatigue occurs in the hook portion 102 of the cover 100 that sandwiches the outer edge of the frame 90 so that the frame 90 is detached from the cover 100. In addition, the following problem can be suppressed: due to the fatigue of the hook portion 102 of the cover 100, the protrusion 84 gets out of the concave groove 102*b*. A vibration conversely transmitted from the outer edge of the frame 90 can be suppressed from being detected by the first to fourth sensors 110 to 140 by mistake. The vibration transmitted from the outer edge of the frame 90 includes, e.g., a transmitted vibration that results from striking on the housing 80, or a vibration transmitted through a stand (not illustrated) holding the housing 80, etc.

The above illustrates the present invention on the basis of the embodiments. However, it is easily understood that the present invention is not limited to any of the above embodiments, and various modifications or alterations may be made without departing from the spirit of the present invention.

Descriptions have been given of the case where the cymbal pad 1 according to the first embodiment is integrally formed by the bell frame 21, the first partitioning frame 22, the bow frame 23, the second partitioning frame 24 and the edge frame 25. Descriptions have been given of the case where the drum pad 70 according to the second embodiment is integrally formed by the vertical frame 91, the horizontal frame 92 and the first to fourth frames 93 to 96. However, the present invention is not limited thereto.

For example, the cymbal pad 1 according to the first embodiment may also be obtained as follows. The first partitioning frame 22 and the second partitioning frame 24 are molded of a material more elastic than the bell frame 21, the bow frame 23 and the edge frame 25, and the parts are then joined together. In this case, due to the elasticity of the first partitioning frame 22 and the second partitioning frame 24, the vibration can be more efficiently attenuated. The same also applies to the drum pad 70 according to the second embodiment.

In addition, a plurality of kinds of variants of the second partitioning frame 24 in the cymbal pad 1 according to the first embodiment have been described. However, the present invention is not limited thereto. For example, the second partitioning frame 24 may also be formed in a W shape, an N shape, an S shape or a wave shape in a cross-sectional view. In this case, the direction of the vibration transmitted between adjacent striking regions is changed, the path of the vibration can be lengthened, and the vibration can be attenuated.

In addition, in the second partitioning frame 24 shown in FIG. 2A, at least one of the first upright portion 24*a* and the second upright portion 24*b* may also protrude more toward the cover 3 than the surface of the frame 2 toward the cover 3. On the contrary, in the second partitioning frame 28 shown in FIG. 3A, at least one of the first upright portion 28*a* and the second upright portion 28*b* may also protrude more toward the side opposite the cover 3 than a rear surface of the frame 2. In this case, the vibration can be more efficiently attenuated.

In addition, the variants of the second partitioning frame 24 described in the above embodiments may also apply to the first partitioning frame 22. Furthermore, the variants of the second partitioning frame 24 may also apply to the vertical frame 91 and the horizontal frame 92 included in the drum pad 70 according to the second embodiment. Furthermore, descriptions have been given of the case where in the drum pad 70 according to the second embodiment, the frame 90 is covered by the cover 100. However, as in the cymbal pad 60 of the second variant shown in FIG. 4B, the cover 100 may also be omitted.

In addition, descriptions have been given of the case where the cymbal pad 1 according to the first embodiment includes one piezoelectric sensor in each of the three partitioned parts, namely, the bell portion 11, the bow portion 12 and the edge portion 13. Descriptions have been given of the case where the drum pad 70 according to the second embodiment includes one piezoelectric sensor in each of the four partitioned parts, namely, the first to fourth pad portions 71, 72, 73 and 74. However, the present invention is not limited thereto. Each part may also be provided with two or more piezoelectric sensors. In this case, the striking position on each part can be more correctly specified.

Descriptions have been given of the case where the frame 2 in the cymbal pad 1 according to the first embodiment is partitioned into three parts by the first partitioning frame 22 and the second partitioning frame 24. Descriptions have been given of the case where the frame 90 in the drum pad 70 according to the second embodiment is partitioned into four parts, namely, the first to fourth frames 93 to 96, by the vertical frame 91 and the horizontal frame 92. However, the present invention is not limited thereto. That is, it is satisfactory as long as the frame 2 is partitioned into two or more parts by components equivalent to the first partitioning frame 22 and the second partitioning frame 24. In addition, it is satisfactory as long as the frame 90 is partitioned into two or more parts by components equivalent to the vertical frame 91 and the horizontal frame 92. In this case, the vibration transmitted between adjacent parts can be attenuated.

In addition, if the output difference between the adjacent piezoelectric sensors is increased, it is not necessary that the first partitioning frame 22 and the second partitioning frame 24 or the vertical frame 91 and the horizontal frame 92 be continuously formed. For example, there may also be discontinuous parts at intermediate positions on the first partitioning frame 22 and the second partitioning frame 24 or at intermediate positions on the vertical frame 91 and the horizontal frame 92.

In addition, in the above first and second embodiments, descriptions have been given of the case where the output difference between the piezoelectric sensors provided at two adjacent parts is compared. However, the present invention is not limited thereto. An output difference between at least two or more piezoelectric sensors may also be compared. That is, in the first embodiment, an output difference between the three sensors, namely, the bell sensor 4, the bow sensor 5 and the edge sensor 6, may also be compared. In addition, in the second embodiment, an output difference between three of or all of the first to fourth sensors 110 to 140 may also be compared. In this case, the striking position can be more correctly specified.

Furthermore, in the above first and second embodiments, descriptions have been given of the case where the vibration of the drum pad or the cymbal pad is detected by use of the piezoelectric sensor (the bell sensor 4, the bow sensor 5, the edge sensor 6 and the first to fourth sensors 110 to 140). That is, descriptions have been given of the case where the vibration is detected by a contact sensor. However, the present invention is not limited thereto. The sensor detecting the vibration may also be a proximity sensor (non-contact sensor) such as an induction type proximity sensor or a capacitance type proximity sensor, etc. If the proximity sensor (non-contact sensor) is used, a response speed, in particular, can be increased.

What is claimed is:

1. An electronic pad, comprising:

a struck body, comprising a first struck portion and a second struck portion adjacent to the first struck portion;

a first vibration sensor, detecting a vibration of the first struck portion; and a second vibration sensor, detecting a vibration of the second struck portion, wherein a partitioning portion is interposed between the first struck portion and the second struck portion, partitioning the first struck portion and the second struck portion from each other, wherein the partitioning portion comprises:

a first upright portion, protruding further than at least one of an upper surface of the first struck portion and a lower surface opposite the upper surface of the first struck portion;

a second upright portion, separated from the first upright portion by a predetermined spacing and protruding further than at least one of an upper surface of the second struck portion and a lower surface opposite the upper surface of the second struck portion; and a connection portion connected between the first upright portion and the second upright portion.

2. The electronic pad according to claim 1, wherein the first upright portion and the second upright portion protrude further than the lower surface of the first struck portion and the second struck portion; and the connection portion is formed connected between an end portion of a part of the first upright portion that protrudes further than the lower surface of the first struck portion and an end portion of a part of the second upright portion that protrudes further than the lower surface of the second struck portion.

3. The electronic pad according to claim 2, wherein the first struck portion and the second struck portion are formed having a predetermined wall thickness; and at least one of the first upright portion and the second upright portion is formed having a length, extending from the lower surface of the first struck portion and the second struck portion to an inner surface of the connection portion, equal to or greater than the predetermined wall thickness.

4. The electronic pad according to claim 3, wherein the connection portion is formed in an arc shape expanding in an opposite direction from the upper surface of the first struck portion and the second struck portion.

5. The electronic pad according to claim 3, wherein the connection portion is formed in a linear shape in a cross-sectional view.

6. The electronic pad according to claim 1, wherein the first upright portion and the second upright portion protrude further than the lower surface of the first struck portion and the second struck portion; and the connection portion is formed connected between an end portion of the first upright portion toward the upper surface of the first struck portion and an end portion of the second upright portion toward the upper surface of the second struck portion.

7. The electronic pad according to claim 6, wherein the first struck portion and the second struck portion are formed having a predetermined wall thickness; and the connection portion is formed having a wall thickness thinner than the predetermined wall thickness.

8. The electronic pad according to claim 7, wherein an inner surface of the connection portion is formed in an arc shape bending toward the upper surface of the first struck portion and the second struck portion.

9. The electronic pad according to claim 6, wherein a surface of the connection portion toward the upper surface of the first struck portion and the second struck portion is formed continuously flat between the upper surface of the first struck portion and the upper surface of the second struck portion.

10. The electronic pad according to claim 1, wherein the first upright portion and the second upright portion protrude further than the upper surface of the first struck portion and the second struck portion; and the connection portion is formed connected between an end portion of a part of the first upright portion that protrudes further than the upper surface of the first struck portion and an end portion of a part of the second upright portion that protrudes further than the upper surface of the second struck portion.

11. The electronic pad according to claim 1, wherein the first struck portion and the second struck portion are formed having a predetermined wall thickness; and at least one or more of the first upright portion, the second upright portion and the connection portion are formed thinner than the predetermined wall thickness.

12. The electronic pad according to claim 1, wherein the connection portion is formed thinner than at least one of the first upright portion and the second upright portion.

13. The electronic pad according to claim 1, wherein the first struck portion and the second struck portion are formed having a predetermined wall thickness; and the partitioning portion forms a groove surrounded by the first upright portion, the second upright portion and the connection portion.

14. The electronic pad according to claim 13, wherein a width of a gap between an inner surface of the first upright portion and an inner surface of the second upright portion of the groove is as long as the predetermined wall thickness.

15. The electronic pad according to claim 13, wherein a length of the groove extending from an opening end of the partitioning portion to an inner surface of the connection portion is twice as long as the predetermined wall thickness.

16. The electronic pad according to claim 1, wherein the partitioning portion is integrally formed with and of the same material as the struck body.

17. The electronic pad according to claim 1, wherein the struck body is formed in a circular shape in a plan view; and the partitioning portion is formed concentrically with the struck body.

18. The electronic pad according to claim 1, comprising a cover, wherein the cover has higher elasticity than the first struck portion and the second struck portion and covers the upper surface of the first struck portion and the upper surface of the second struck portion.

19. The electronic pad according to claim 1, wherein the struck body is formed in a rectangular shape in a plan view; and the partitioning portion is formed so that the struck body is partitioned by a vertical frame and a horizontal frame intersecting in a cross shape.

* * * * *